US007316101B1

(12) United States Patent
Nguyen et al.

(10) Patent No.: US 7,316,101 B1
(45) Date of Patent: Jan. 8, 2008

(54) METHOD AND APPARATUS FOR VACUUM SEALING ZIP LOCK PLASTIC BAGS

(76) Inventors: Vincent Nguyen, 19035 Buffalo River Way, Houston, TX (US) 77084; David W. Vice, 5401 De Milo, Houston, TX (US) 77092

( * ) Notice: Subject to any disclaimer, the term of this patent is extended or adjusted under 35 U.S.C. 154(b) by 0 days.

(21) Appl. No.: 11/212,445

(22) Filed: Aug. 27, 2005

(51) Int. Cl.
*B65B 31/04* (2006.01)

(52) U.S. Cl. ..... 53/408; 53/434; 53/79

(58) Field of Classification Search ..... 53/403, 53/408, 432, 434, 510, 97, 79
See application file for complete search history.

(56) References Cited

U.S. PATENT DOCUMENTS

| | | | | |
|---|---|---|---|---|
| 3,339,606 A | | 9/1967 | Kugler | |
| 3,440,696 A | * | 4/1969 | Staller | 24/586.1 |
| 4,018,253 A | | 4/1977 | Kaufman | |
| 4,519,095 A | * | 5/1985 | Clayton | 383/86 |
| 4,791,710 A | * | 12/1988 | Nocek et al. | 24/585.12 |
| 4,947,525 A | * | 8/1990 | Van Erden | 24/304 |
| 5,287,680 A | | 2/1994 | Lau | |
| 5,544,752 A | | 8/1996 | Cox | |
| 5,701,996 A | | 12/1997 | Goto et al. | |
| 5,829,884 A | | 11/1998 | Yeager | |
| 5,873,217 A | | 2/1999 | Smith | |
| 6,085,906 A | | 7/2000 | Lambert | |
| 6,499,600 B2 | | 12/2002 | Koyanagi | |
| 6,763,857 B2 | | 7/2004 | Brown | |
| 2004/0091179 A1 | * | 5/2004 | Anderson | 383/63 |
| 2006/0048483 A1 | * | 3/2006 | Tilman et al. | 53/434 |

* cited by examiner

*Primary Examiner*—Thanh K. Truong
*Assistant Examiner*—Paul Durand
(74) *Attorney, Agent, or Firm*—Kenneth A. Roddy

(57) ABSTRACT

A vacuum sealing method and system for evacuating air from and sealing a flexible plastic bag of the type having a mating male rib and a female sealing channel closure along the length of the bag opening. A flowable liquid is applied to the female channel. The rib and channel are engaged along their length to leave a short portion of the closure unclosed, a hollow tubular evacuation tube connected with a vacuum pump is inserted into the bag through the unclosed portion, pinching pressure is manually applied to sandwich the evacuation tube between the unclosed portion to prevent air from escaping, the vacuum pump is operated to withdraw a substantial amount of air from the bag, and thereafter the evacuation tube is quickly pulled from the bag so that the pinching pressure is transferred to the closure thereby closing the unclosed portion and sealing the evacuated bag with the liquid filling voids between the mating elements and providing a supplemental seal to increase resistance to air entering the sealed bag.

3 Claims, 5 Drawing Sheets

METHOD AND APPARATUS FOR VACUUM SEALING ZIP LOCK PLASTIC BAGS

BACKGROUND OF THE INVENTION

1. Field of the Invention

This invention relates generally to flexible bag sealing apparatus and methods for vacuum sealing flexible plastic bags, and more particularly to a sealing system and method for vacuum sealing conventional plastic bags of the type having a mating male rib or bead and female sealing channel along the length of the bag opening.

2. Background Art

Closable plastic bags, particularly food storage bags, such as those commercially known as ZIPLOC® or GLAD-LOCK® bags, are widely used to preserve food. Such bags, also known as "zipper bags" or "profile bags", typically have a mating male rib or bead and female channel extending along the opening of the bag that form an airtight closure when properly aligned and pressed together along the length of the bag opening. Naito, U.S. Pat. RE 28,969 discloses an example of an airtight profile closure is that used in the ZIPLOC® storage bag. The airtight closure it typically formed as an integral part of the bag and allows products stored in the bag to be easily removed and re-stored.

The freshness and quality of the product stored within the bag is to a large measure dependent upon the bag being substantially free of air. Thus, to preserve the contents of the bag in a fresh state, without loss of flavor and texture, it is desirable to evacuate or vacuum seal the bag. In sealing such profile closure bags, the user will usually attempt to manually squeeze the air from the bag while simultaneously trying to seal the opening. Unfortunately, the volume of air removed is generally inadequate, and air can still re-enter and become trapped in the bag upon initial sealing or re-sealing.

Others have attempted to overcome problems associated with manually sealing such profile closures by modifying the closure, providing specially designed bags, or providing bag attachments for evacuating the bag.

Kugler, U.S. Pat. No. 3,339,606 discloses a tongue and grove profile closure wherein the tongue is of a thickness less than the width of the groove and a releasable pressure sensitive adhesive is provided to keep the tongue within the groove. Adhesives, however, are difficult to apply, and may cause undesirable problems by sticking to other bags or miscellaneous surfaces.

Goto et al, U.S. Pat. No. 5,701,996 discloses a specially designed snap-fastener bag having a deaerating passage along a bottom-seal and a conventional snap fastener provided along the bag opening. The deaerating passage has an opening through one side of the bag and a sticky substance, such as polybutene, is disposed in the passageway to adhere the top and bottom plies of the plastic film of the bag after manually deaerating the bag.

Cox, U.S. Pat. No. 5,544,752, and Lambert, U.S. Pat. No. 6,085,906 disclose specially constructed evacuable storage bags having an integrally formed flexible conduit directed through the bag and into fluid communication with the interior of the bag and sealing strips positioned within or on the exterior of the conduit wherein pressure applied to an exterior of the conduit will effect collapsing thereof and cooperative engagement of the conduit sealing strips to preclude fluid communication through the conduit.

Kaufman, U.S. Pat. No. 4,018,253 discloses a vacuum device for freezer bags which includes a hollow retainer member adapted to receive the open end of the bag, and a cap member which is adapted to fit over the outside surface of the retainer in airtight engagement therewith. A flexible tube extends downwardly through the bottom end of the cap member and upwardly above the cap member, and a valve is provided on the upward part of the tube. The open end of the bag is inserted through the hollow retainer and draped over the top end of the retainer, and the cap is mounted over the top surface of the retainer and the open end of the bag in airtight engagement therewith so that the tube passage is in airtight communication with the interior of the bag. Air is withdrawn from the container through the tube, and the valve on the tube is then closed to close the tube passage.

Others have attempted to overcome problems associated with manually sealing bags having conventional profile closures by providing nozzle attachments that are to be connected with a household vacuum cleaner hose for evacuating the bag, which require additional time and trouble to relocate the vacuum cleaner.

Brown, U.S. Pat. No. 6,763,857 discloses a vacuum attachment for use with a vacuum hose and a vacuum device, and a conventional plastic food storage bag. The vacuum attachment has a first hollow substantially frusto-conical attachment member for attaching the vacuum attachment to the vacuum hose, and a generally cylindrical inserter member for inserting the vacuum attachment into the bag. The vacuum attachment may also have an air flow blocker for blocking the air flow between the bag and the vacuum attachment. The air flow blocker is a hollow substantially cylindrical cap with a closed end, and may be provided with an opening or a filter.

Smith, U.S. Pat. No. 5,873,217 discloses a vacuum sealing method and nozzle adaptor apparatus for sealing a container such as a zipper-type plastic bag. The nozzle adapter has an elongated nozzle end for insertion into the container or bag and a larger vacuum hose-engaging end for engaging the hose of an existing vacuum source such as household vacuum cleaner. The elongate end of the nozzle is placed in the bag, the bag is sealed as completely as possible around the nozzle, the vacuum source is turned on. After the air is withdrawn from the bag, the nozzle is quickly removed from the bag and the open portion of the zipper-type seal is quickly engaged before a substantial amount of air can return into the bag.

Lau, U.S. Pat. No. 5,287,680 overcomes the problems associated with vacuum cleaner nozzle attachments by providing a hand-held battery operated vacuum packing device for evacuating and sealing a conventional plastic bag. The device has a housing with a pair of jaw elements mounted on a lever with a slot therebetween through which the edges of the bag are pulled to press fit the edges together. A nozzle extends outwardly from the housing and an air extractor fan in the housing withdraws air from the bag immediately before sealing is complete. With the jaws in an open position, the two mating edges of the bag are threaded together into the slot between the two jaw elements and the nozzle is placed in the bag. The lever is then operated to close the jaws. The bag and the vacuum packing device are then pulled in opposite directions, so that the two edges of the bag are pulled past the nozzle and through the slot into sealing engagement with one another. When the bag is sealed along almost the entire length of the edges, the extractor fan is operated to extract air from the bag through the nozzle. The lever is then released to open the jaws and the nozzle is withdrawn, and the sealing of the bag is completed manually.

A variety of specially designed large storage bags having air valve arrangements are also known in the art, such as disclosed in Yeager, U.S. Pat. No. 5,829,884 and Koyanagi, U.S. Pat. No. 6,499,600 have been proposed for the purpose of removing air from the storage bags in order to reduce the volume of an item, such as clothing, inside the bag to facilitate storage.

A variety of combination vacuum and heat sealing devices that include an electrical heat sealing unit combined with a vacuum pump are known in the art. Most of these types of heat sealing devices are not particularly suited for use with conventional profile closure bags and require special plastic bags, and some may cause burns and/or fumes, which may be potentially harmful.

Consequently, a need exists for a vacuum sealing system that will allow the user to vacuum pack the contents of a resealable flexible plastic bag that overcomes the foregoing drawbacks.

The present invention is distinguished over the prior art in general, and these patents in particular by a vacuum sealing method and system for evacuating air from and sealing a flexible plastic bag of the type having a mating male rib and a female sealing channel closure along the length of the bag opening, wherein a flowable liquid is applied to the female channel, the rib and channel are engaged along their length to leave a short portion of the closure unclosed, a hollow tubular evacuation tube connected with a vacuum pump is inserted into the bag through the unclosed portion, pinching pressure is manually applied to sandwich the evacuation tube between the unclosed portion to prevent air from escaping, the vacuum pump is operated to withdraw a substantial amount of air from the bag, and thereafter the evacuation tube is quickly pulled from the bag so that the pinching pressure is transferred to the closure thereby closing the unclosed portion and sealing the evacuated bag with the liquid filling voids between the mating elements and providing a supplemental seal to increase resistance to air entering the sealed bag.

SUMMARY OF THE INVENTION

It is therefore an object of the present invention to provide a vacuum sealing system and method for sealing conventional plastic bags of the type having a mating male rib or bead and female sealing channel along the length of the bag opening.

It is another object of this invention is to provide a vacuum sealing system and method for sealing conventional profile closure plastic bags wherein a liquid is applied to the female sealing channel of the bag to significantly reduce air leakage and facilitate a long lasting sealed condition.

Another object of this invention to provide a vacuum sealing system and method for sealing conventional profile closure plastic bags that is simple in operation and particularly suited for home use to allow a user to quickly and easily evacuate air from the bag and seal the bag to preserve the contents in a fresh state, without loss of flavor and texture.

Another object of this invention is to provide a liquid supplemented mating male rib or bead and female sealing channel type closure for conventional profile closure plastic bags wherein liquid is applied to the female sealing channel of the bag to significantly reduce air leakage and facilitate a long lasting sealed condition.

Another object of this invention is to provide a self contained vacuum sealing system for evacuating air from conventional profile closure plastic bags that does not require connection to a separate vacuum source.

A further object of this invention is to provide a vacuum sealing system and method for evacuating air from a flexible plastic bag that does not require customized storage bags having integrally formed air valves or conduit arrangements directed through the bag sealing strips.

A still further object of this invention is to provide a vacuum sealing apparatus for sealing conventional plastic bags that is simple in construction, inexpensive to manufacture and rugged and reliable in operation.

Other objects of the invention will become apparent from time to time throughout the specification and claims as hereinafter related.

The above noted objects and other objects of the invention are accomplished by the present vacuum sealing method and system for evacuating air from and sealing a flexible plastic bag of the type having a mating male rib and a female sealing channel closure along the length of the bag opening, wherein a flowable liquid is applied to the female channel, the rib and channel are engaged along their length to leave a short portion of the closure unclosed, a hollow tubular evacuation tube connected with a vacuum pump is inserted into the bag through the unclosed portion, pinching pressure is manually applied to sandwich the evacuation tube between the unclosed portion to prevent air from escaping, the vacuum pump is operated to withdraw a substantial amount of air from the bag, and thereafter the evacuation tube is quickly pulled from the bag so that the pinching pressure is transferred to the closure thereby closing the unclosed portion and sealing the evacuated bag with the liquid filling voids between the mating elements and providing a supplemental seal to increase resistance to air entering the sealed bag.

DESCRIPTION OF THE PREFERRED EMBODIMENT

Figure 1:
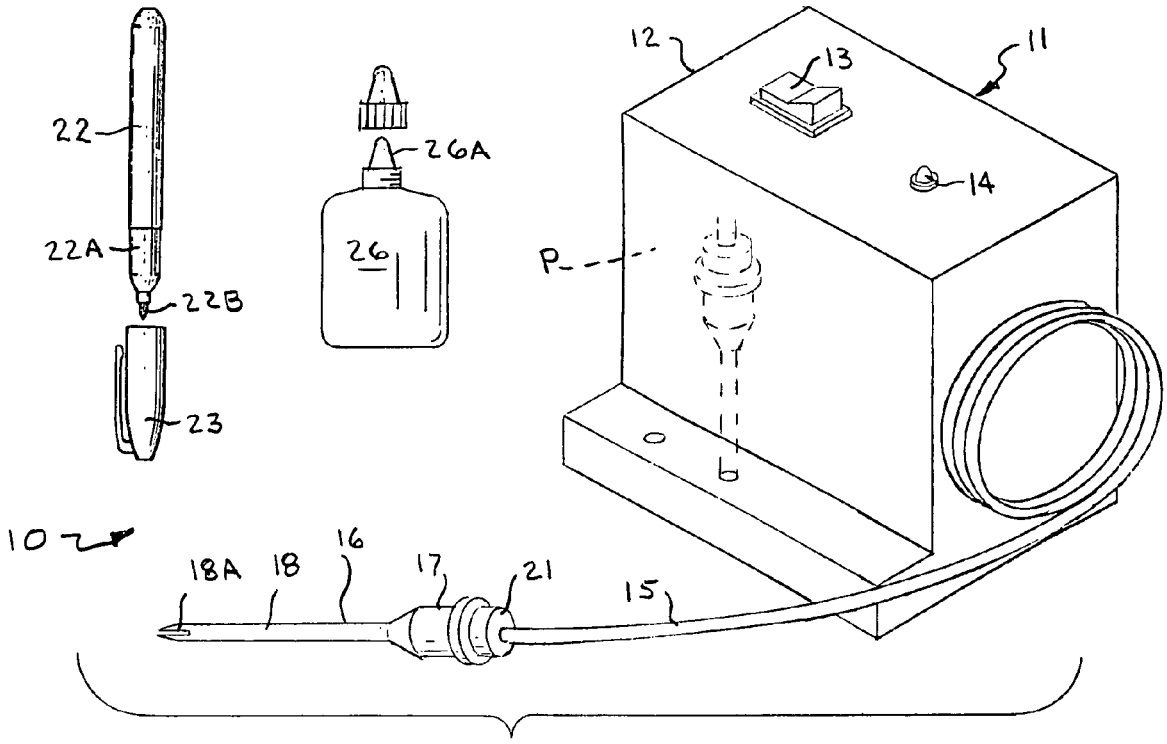
FIG. 1 is a perspective view of the vacuum pump and evacuation tube apparatus of the vacuum sealing system for sealing a flexible plastic bag of the type having a mating male rib and a female sealing channel closure.

Referring to the drawings by numerals of reference, there is shown in FIG. 1, a preferred vacuum sealing system 10 that allows a user to vacuum pack the contents of a resealable flexible plastic bag of the type having a mating male rib or bead and female sealing channel closure along the length of the bag opening. As used herein the term vacuum refers to an environment containing little or no air.

The vacuum sealing system 10 includes a vacuum pump apparatus 11 having a housing 12 which contains a conventional electrically driven vacuum pump P which may be, for example, a diaphragm pump or other type of miniature pump driven by an electric motor connectable with an electrical power source through an on-off switch 13 and an indicator light 14 such as a light emitting diode. The power source may be either 120v AC household voltage (in which case a transformer is disposed between the pump and the source), or it may be powered by disposable or rechargeable DC batteries. The pump, electrical circuitry and wiring details are conventional and well known in the art and therefore not shown or described in detail. A length of small diameter flexible hose or tubing 15 is connected at a first end to the suction side of the pump P and an evacuation tube 16 is connected to the opposed or second end of the hose or tubing.

Figure 2:
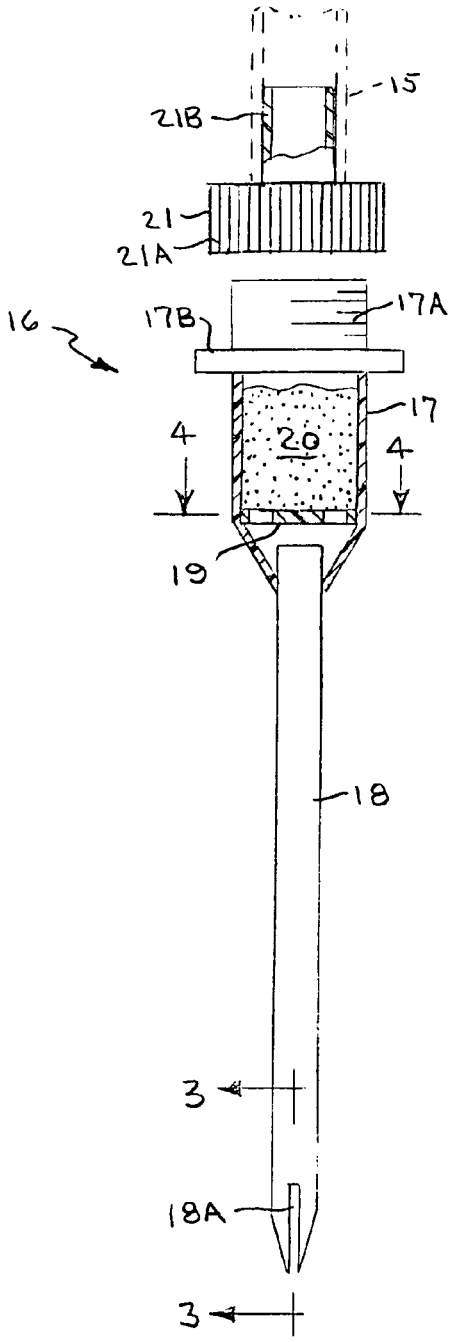
FIG. 2 is an elevation view of the evacuation tube of the vacuum sealing system, shown in partial cross section.
Figure 4:
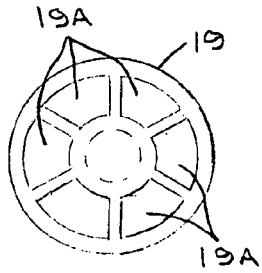
FIG. 4 is a top plan view taken along line 4-4 of a spider member of the evacuation tube.
Figure 3:
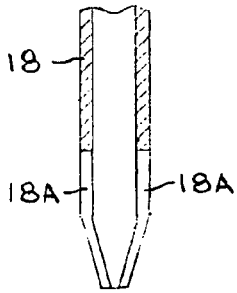
FIG. 3 is longitudinal cross section taken along line 3-3 of the lower end of the evacuation tube.

As best seen in FIGS. 2, 3 and 4, the evacuation tube 16 has a hollow tubular upper portion 17 and a rigid elongate tubular lower portion 18 that is smaller in cross section than the upper portion. The lower end of the side wall of the elongate tubular lower portion 18 of the evacuation tube is provided with one or more longitudinal slots 18A that extend upwardly a short distance from its bottom end. It should be understood that the side wall of the elongate tubular lower portion 18 of the evacuation tube 16 may be of a tubular or circular cross section, or may be of a polygonal cross section. Preferably, the tubular lower portion 18 is approximately 6 to 8 inches in length, and about ⅛ of an inch or less in diameter or major transverse dimension.

The upper portion 17 of the evacuation tube 16 is provided with external threads 17A at its upper end and a radial flange 17B beneath the threads. The interior of the upper portion 17 may be provided with spider member 19 disposed near its juncture with the smaller tubular lower portion 18, which has a plurality of openings or air passageways 19A formed therethrough. A small replaceable filter 20 formed of porous cellular material, such as polyurethane foam, is received in the interior of the upper portion and removably supported on the spider 19.

A removable cap 21 having an internally threaded lower portion 21A and a smaller diameter upper portion 21B is threadedly and removably engaged on the external threads 17A at the upper end of the evacuation tube 16, and its smaller diameter upper portion 21B is received and frictionally engaged in the second end of the hose or tubing 15.

In a preferred embodiment, the present vacuum sealing system 10 also includes a liquid applicator 22 that contains a low-viscosity liquid, such a vegetable oil, which is used to apply a small quantity of the liquid onto the male/female fastener elements of the plastic bag, as described hereinafter. The applicator has a body 22A with a protruding porous applicator tip 22B and an end cap 23, which is sized to fit onto the lower end of the body and enclose the protruding applicator tip when not in use.

Figure 5:
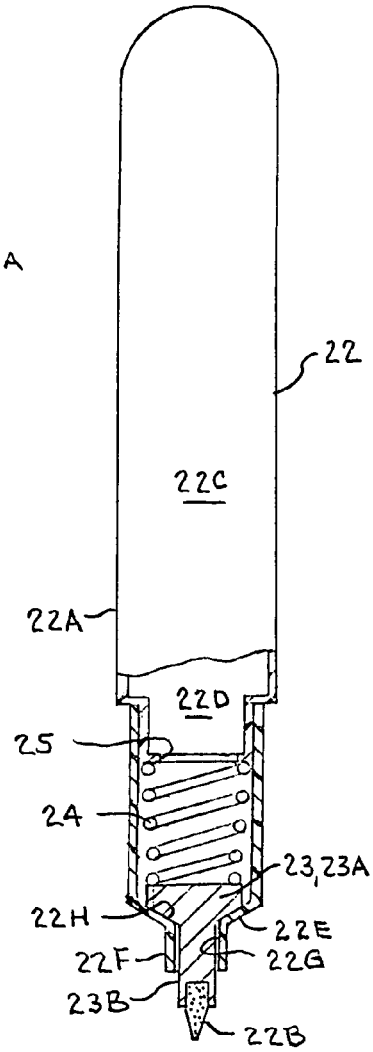
FIG. 5 is an elevation view of the liquid applicator pen, with the lower portion shown in cross section.

FIG. 5 shows the internal construction of the liquid applicator 22 in detail. The liquid contained therein is not shown to avoid confusion. The body 22A has a hollow generally cylindrical main portion 22C defining an interior liquid reservoir chamber 22D, which is enclosed at one end and has an opposed conical end 22E adjoining a smaller diameter tubular portion 22F with an opening 22G extending therethrough. The conical portion 22E between the main body portion 22C and the smaller diameter tubular portion 22F defines a conical interior valve seat 22H.

A small valve member 23 having a conical upper portion 23A received on the conical valve seat 22H and a small diameter cylindrical lower end 23B extending through the opening 22G of the smaller diameter tubular portion 22F is slidably mounted in the lower end of the applicator body 22. The porous applicator tip 22B is formed of porous cellular material, such as polyurethane foam, and is secured in a small bore in the outer end of the valve member 23. A compression spring 24 has one end engaged on the conical upper portion 23A of the valve member 23 and its opposed end is engaged on a spring retainer ring 25 disposed in the lower end of the main body 22C. The outer diameter of the conical upper portion 23A of the valve member 23 is smaller than the interior diameter of the reservoir chamber 22D. The spring 24 urges the conical upper portion 23A of the valve member 23 into fluid sealing engagement with the conical valve seat 22H in a normally closed position to prevent liquid from exiting the reservoir chamber 22D.

When the applicator tip 22B is pressed against a surface, the conical portion 23A of the valve member 23 is raised off of the valve seat 22H to an open position allowing liquid (not shown) contained in the reservoir chamber 22D to flow around the conical upper portion and small diameter cylindrical lower end 23B of the valve member and is become absorbed into the porous cellular material of the applicator tip 22B.

It should be understood that, depending upon the viscosity of the liquid used, the liquid applicator 22 may also be constructed in the manner of a conventional felt-tip pen, wherein the applicator tip is formed of felt or other fibrous material and is permanently mounted in the end of the main body and in fluid communication with the liquid contents, and the liquid is drawn by capillary action into the fibrous material to saturate the applicator tip. Alternatively, the liquid may also be maintained in a saturated fibrous cartridge disposed in the reservoir chamber 22D which is in fluid communication with the applicator tip, whereby the liquid is drawn by capillary action from the fibrous material cartridge into the applicator tip.

Again, depending upon the depending upon the viscosity of the liquid used, the liquid applicator may also be provided as a small plastic squeeze container 26 (FIG. 1) having a nozzle 26A with a small orifice for dispensing a drop of the liquid when inverted or squeezed, such as an eye drop or nasal spray container.

In sealing food storage bags, the liquid contained in the applicator reservoir 22D is a low-viscosity liquid, such as vegetable oil, olive oil, or cooking oil having a viscosity generally similar to that of water. When sealing bags that contain other non-edible products, other low-viscosity liquids, such as mineral oil or machine oil may be used.

Figure 6A:
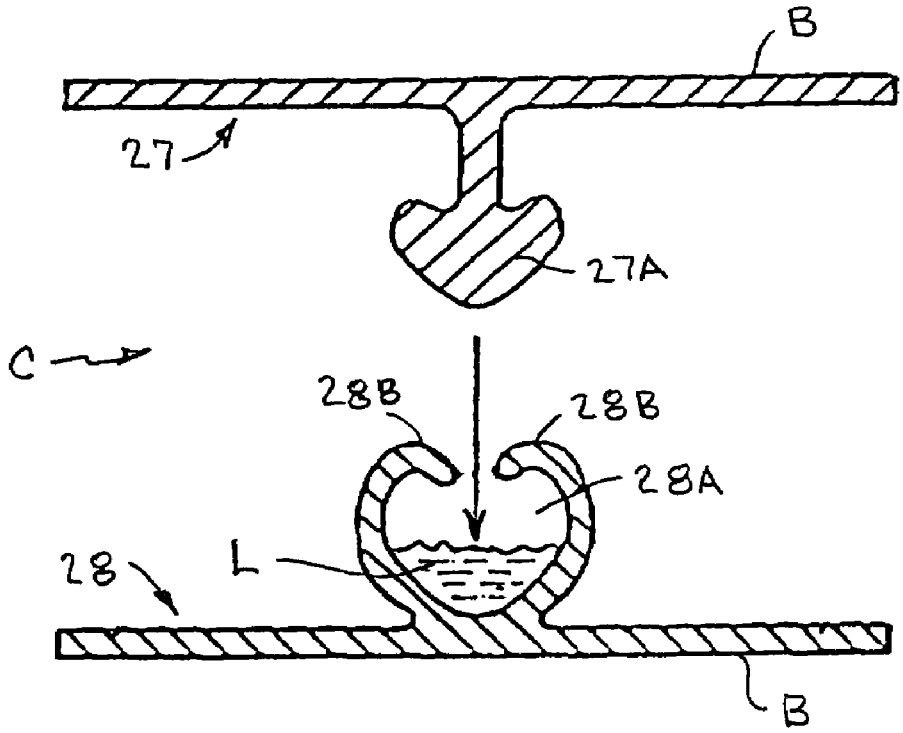
FIGS. 6A and 6B are enlarged transverse cross sectional views of a mating male rib or bead and female channel of a flexible plastic bag, respectively.
Figure 6B:
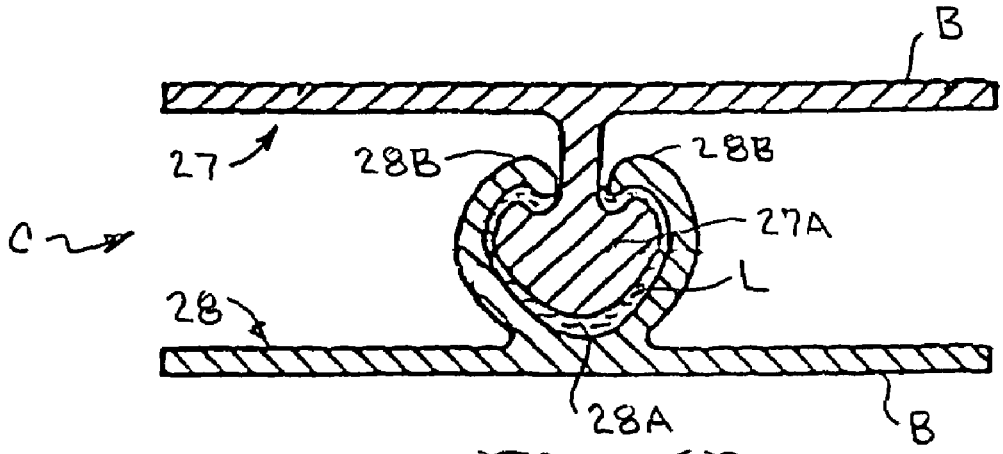

The present vacuum sealing system is particularly suited for evacuating the air from within a conventional resealable flexible plastic bag of the type having a mating male rib or bead and female sealing channel closure along the length of the bag opening. FIGS. 6A and 6B show a typical conventional male 27 and female 28 sealing channel closure C in enlarged detail. For purposes of illustration, the conventional rib and groove is shown as an arrowhead shaped rib 27A that is received by the locking jaws 28B of a coacting female groove 28A, but it will be understood and appreciated by those versed in the art that certain principles of the invention may apply equally to other modified forms of zipper closures and the reference to the rib and groove is not limiting except to the extent which the principles apply primarily to a rib and groove relationship. It should be understood that the present invention is not to be limited to the specific form of rib and groove illustrated in the drawings.

OPERATION

Figure 7:
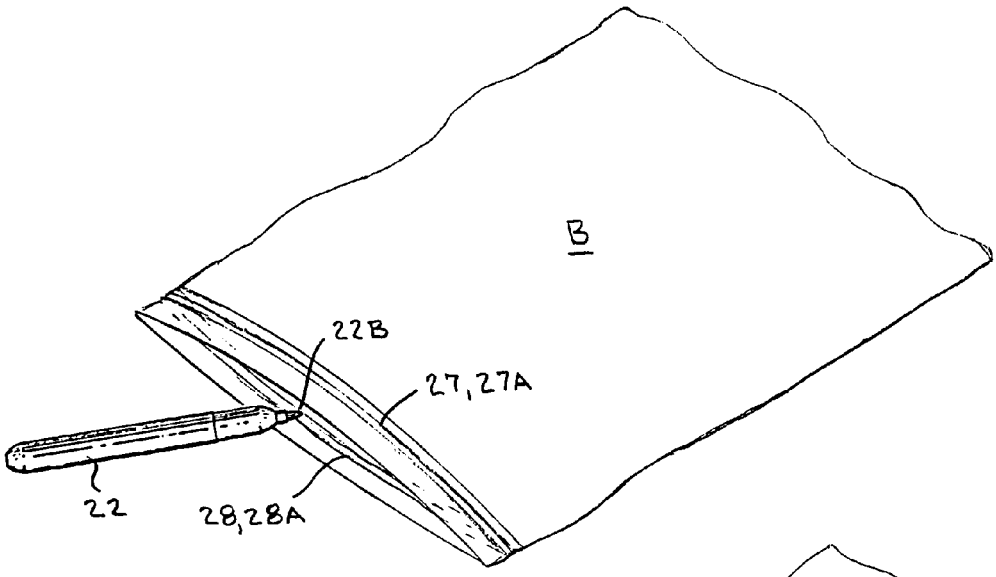
FIGS. 7-9 are pictorial views illustrating the steps in evacuating and sealing the flexible bag.
Figure 8:
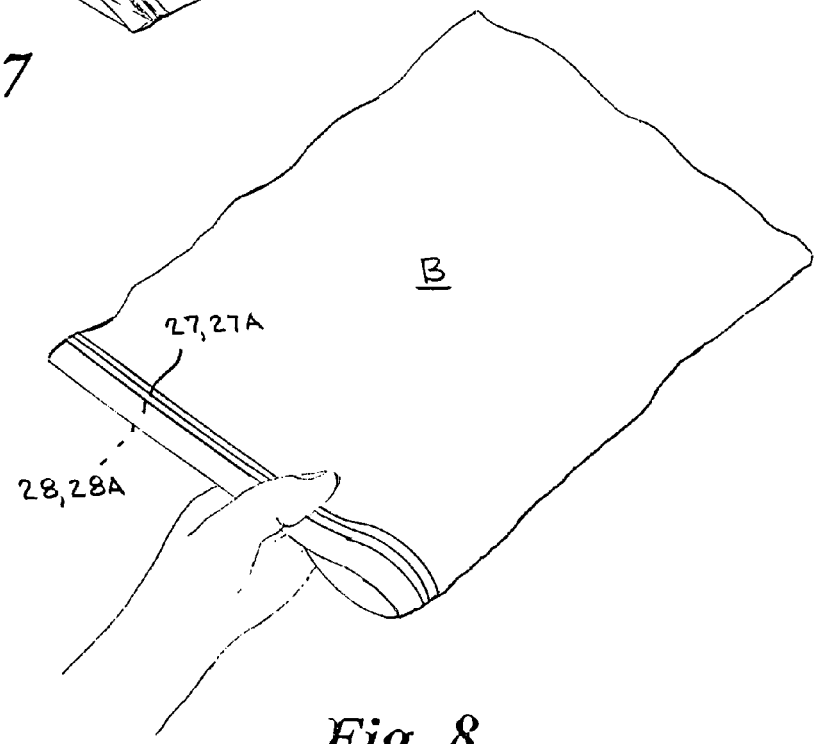
Figure 9:
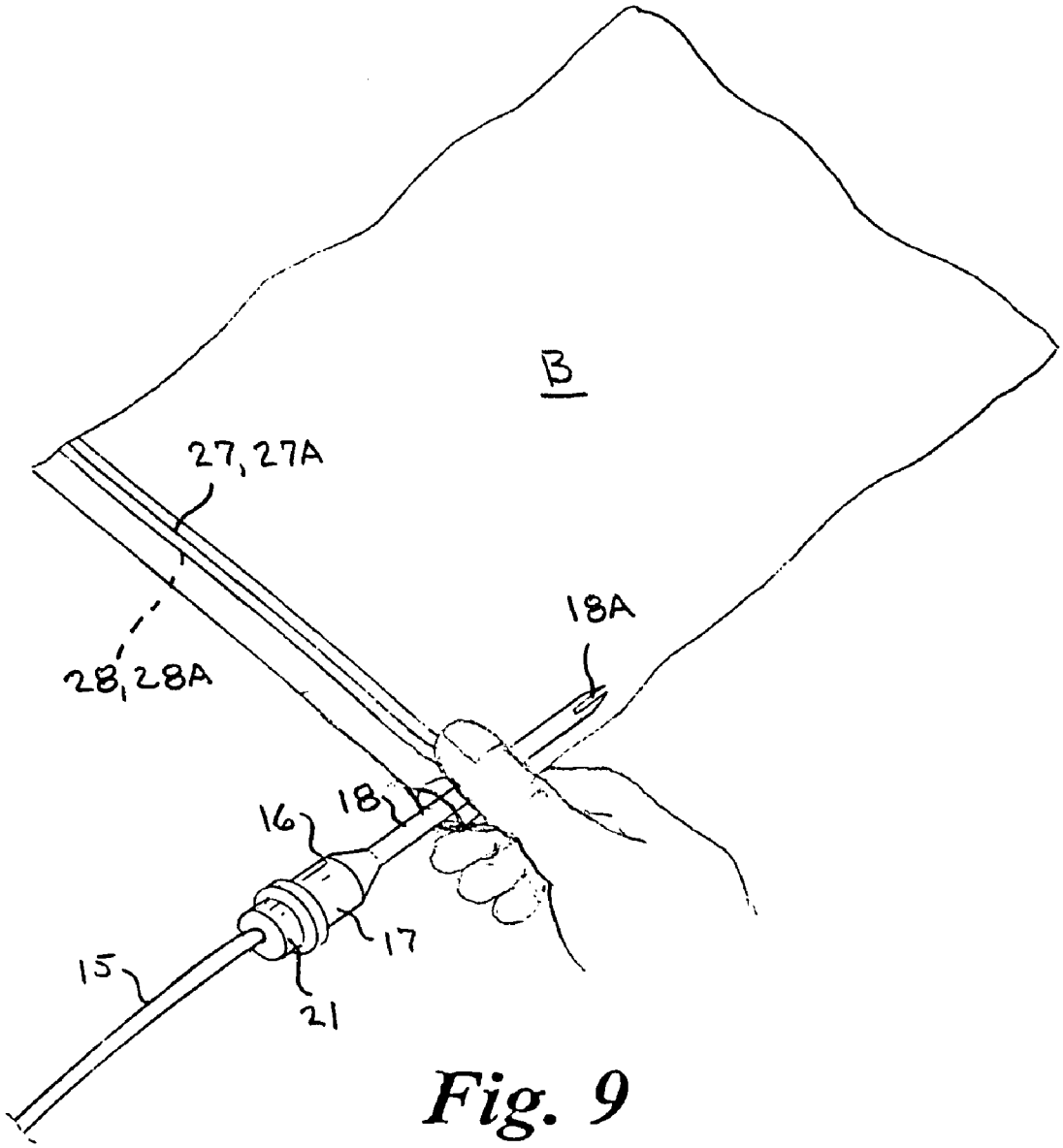

Referring now additionally to FIGS. 7, 8 and 9, in a liquid supplemented sealing method, the liquid applicator 22 is used to apply a small amount of the liquid L contained therein to the female channel 28A of the bag closure. This is accomplished by opening the sealing channel closure of the bag B, placing the porous tip 22B of the applicator 22 at one end of the female channel 28A and sliding it along the channel to the opposite end (FIG. 7), or by applying a drop of the liquid into the female channel. The liquid L then runs into the channel 28A and becomes generally evenly distributed therein along its length (FIG. 6A). The item or items to be stored may be inserted into the body of the bag before or after application of the liquid into the female channel.

The user then partially closes the bag B by pinching the mating male rib or bead 27A and female channel 28A together and running their thumb and forefinger along the length of the closure, but leaving a short length unclosed of sufficient size to receive the elongate tubular lower portion of the evacuation tube (FIG. 8), and then inserts the tubular lower portion 18 of the evacuation tube 16 into the bag through the small opening formed by the unclosed portion of the seal (FIG. 9).

After the elongate tubular lower portion 18 of the evacuation tube 16 has been inserted, the user, with their thumb and forefinger, tightly pinches the unclosed portion of the rib or bead 17A and channel 28A closely around the lower portion of the evacuation tube sandwiched therebetween to prevent air from escaping (FIG. 9).

While holding the pinching pressure on the rib or bead 27A and channel 28A and sandwiched lower portion 18 of the evacuation tube 16, the user turns the on-off switch to the "on" position to activate the pump apparatus. The elongate slots 18A on the lower end of the side wall of the tubular lower portion 18 of the evacuation tube 16 substantially prevent the interior surface of the bag from being sucked in and plugging the bore at the end of the tube. The evacuation tube 16 may also be manually rotated about its axis in the event that the interior surface of the bag does get drawn into the bore or slots, to open the evacuation passageway.

After the desired amount of air has been evacuated, and while maintaining the pinching pressure, the lower portion 18 of the evacuation tube 16 is quickly pulled from the bag, and the pinching pressure is automatically transferred to engage and pinch closed the previously unclosed portion of the rib or bead 17A and channel 28A, and thereby sealing the evacuated bag.

As shown in FIG. 6B, when the mating male rib or bead 27A and female channel 18A closure is closed, the liquid L in the channel will occupy any voids between the surfaces of the engaged mating elements and serve as a supplemental seal to prevent air from entering, and maintain the seal for a significantly longer period than would be maintained by the engaged mating elements in a dry condition.

However, it should be understood that the vacuum sealing method may also be carried out without first applying the liquid into the female channel of the bag closure to achieve an effective vacuum seal.

The liquid supplemented sealing method may also be carried out to achieve a superior long-lasting air leakage resistant seal by manually venting air from the bag rather than utilizing the pump. In this method, the liquid applicator 22 is used to apply a small amount of the liquid contained therein to the female channel 28A of the bag closure, as described above. The liquid then runs into the channel and becomes generally evenly distributed therein along its length. The item or items to be stored may be inserted into the body of the bag before or after application of the liquid into the female channel.

The user then manually squeezes air from the bag and, while pinching the mating male rib or bead and female channel together, runs their thumb and forefinger along the length of the opening, in a conventional manner, to engage and close the rib or bead and channel, and thereby sealing the evacuated bag. When the mating male rib or bead and female channel closure is closed, the liquid in the channel will occupy any voids between the surfaces of the engaged mating elements and serve as a supplemental seal to prevent air from entering, and maintain the seal for a significantly longer period than would be maintained by the engaged mating elements in a dry condition.

While this invention has been described fully and completely with special emphasis upon preferred embodiments, it should be understood that within the scope of the appended claims the invention may be practiced otherwise than as specifically described herein.

The invention claimed is:

1. A method for sealing an article in a flexible plastic bag of the type having a mating male rib or bead and a female sealing channel closure along the length of the bag opening, comprising the steps of:

placing said article into said flexible plastic bag;

applying a flowable liquid to the female channel of the bag closure so that it flows into the female channel and becomes generally evenly distributed therein along its length;

engaging the rib or bead and female channel together along the length of the opening so as to leave a short portion of the closure unclosed;

venting a substantial amount of air from the bag through the unclosed portion of the closure; and thereafter manually applying pinching pressure to the unclosed portion of the closure to engage and close the rib or bead and female channel of the unclosed portion of the closure along its length to seal the bag; whereby the liquid in the channel occupies voids between the surfaces of the engaged mating elements to provide a supplemental seal to increase resistance to air entering the sealed bag.

2. The method according to claim 1, wherein said step of venting a substantial amount of air from the bag through the unclosed portion of the closure comprises the steps of:

inserting an evacuation tube connected with a vacuum source into the bag between the rib or bead and female channel of the unclosed portion of the closure;

applying manual pressure to form a substantially airtight seal around the evacuation tube; and activating the vacuum source to withdraw a substantial amount of air from the bag through the evacuation tube.

3. A method for sealing an article in a flexible plastic bag of the type having a mating male rib or bead and a female sealing channel closure along the length of the bag opening, comprising the steps of:

placing said article into said flexible plastic bag;

applying a flowable liquid to the female channel of the bag closure so that it flows into the female channel and becomes generally evenly distributed therein along its length;

engaging the rib or bead and female channel together along the length of the opening and leaving a short portion of the closure unclosed of sufficient size to receive an evacuation tube connected with a vacuum source;

inserting the evacuation tube into the bag through the unclosed portion;

manually applying pinching pressure to sandwich the evacuation tube between the unclosed portion of the closure to substantially prevent air from escaping;

activating the vacuum source to withdraw a substantial amount of air; and thereafter quickly pulling the sandwiched evacuation tube from the bag so that the pinching pressure is transferred to the closure thereby engaging and pinching closed the previously unclosed portion of the closure and sealing the evacuated bag; whereby the liquid in the channel occupies voids between the surfaces of the engaged mating elements to provide a supplemental seal to increase resistance to air entering the sealed bag.

* * * * *